US009976392B2

(12) United States Patent
Lastra et al.

(10) Patent No.: US 9,976,392 B2
(45) Date of Patent: May 22, 2018

(54) HYDRAULICALLY ASSISTED DEPLOYED ESP SYSTEM

(71) Applicant: Saudi Arabian Oil Company, Dhahran (SA)

(72) Inventors: Rafael Adolfo Lastra, Dhahran (SA); Abubaker Saeed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days. days.

(21) Appl. No.: 14/980,748

(22) Filed: Dec. 28, 2015

(65) Prior Publication Data

US 2016/0194939 A1 Jul. 7, 2016

Related U.S. Application Data

(60) Provisional application No. 62/099,253, filed on Jan. 2, 2015.

(51) Int. Cl.

| | |
|---|---|
| ***E21B 41/00*** | (2006.01) |
| ***E21B 43/12*** | (2006.01) |
| ***E21B 23/08*** | (2006.01) |
| *E21B 23/00* | (2006.01) |

(52) U.S. Cl.

CPC ..... *E21B 41/00* (2013.01); *E21B 23/08* (2013.01); *E21B 43/128* (2013.01); *E21B 2023/008* (2013.01)

(58) Field of Classification Search

CPC .... E21B 2023/008; E21B 23/08; E21B 41/00; E21B 43/128; E21B 43/126

See application file for complete search history.

(56) References Cited

U.S. PATENT DOCUMENTS

| | | | | |
|---|---|---|---|---|
| 4,391,330 A * | 7/1983 | Kiefer | ..... | E21B 17/003 166/341 |
| 6,454,011 B1 | 9/2002 | Schempf et al. | | |
| 7,748,449 B2 | 7/2010 | Bussear et al. | | |
| 8,381,820 B2 | 2/2013 | Martinez | | |

(Continued)

FOREIGN PATENT DOCUMENTS

WO 0102699 A1 1/2001

OTHER PUBLICATIONS

International Search Report and Written Opinion for related PCT application PCT/US2015/068257 dated Mar. 31, 2016.

*Primary Examiner* — James G Sayre
(74) *Attorney, Agent, or Firm* — Bracewell LLP; Constance G. Rhebergen

(57) ABSTRACT

A system and method for providing artificial lift to production fluids within a subterranean well includes loading an electrical submersible pump assembly into an interior cavity of a pump launcher. The electrical submersible pump assembly has a motor and a pump and is releasably secured to a piston device. The piston device has an outer diameter profile. The pump launcher is releasably secured to a wellhead so that the interior cavity is in fluid communication with an inner bore of a production tubing that extends a length into the subterranean well. A propulsion system is activated to move the electrical submersible pump assembly from the pump launcher and into the subterranean well. The piston device can be communicated with to control the descent of the electrical submersible pump assembly through the subterranean well.

17 Claims, 4 Drawing Sheets

(56) References Cited

U.S. PATENT DOCUMENTS

| | | | | |
|---|---|---|---|---|
| 8,844,636 | B2 | 9/2014 | Bebak et al. | |
| 9,080,412 | B2 * | 7/2015 | Wetzel | E21B 43/128 |
| 2001/0050173 | A1 * | 12/2001 | Head | E21B 17/003 166/381 |
| 2004/0188096 | A1 | 9/2004 | Traylor | |
| 2008/0128128 | A1 * | 6/2008 | Vail | E21B 43/128 166/250.15 |
| 2010/0116506 | A1 * | 5/2010 | Sbordone | E21B 33/076 166/345 |
| 2010/0212914 | A1 * | 8/2010 | Traylor | E21B 43/128 166/377 |
| 2013/0180730 | A1 * | 7/2013 | Bebak | E21B 23/08 166/381 |
| 2013/0222148 | A1 * | 8/2013 | Gano | G01V 3/34 340/853.3 |
| 2015/0136424 | A1 * | 5/2015 | Hughes | E21B 19/22 166/381 |

* cited by examiner

HYDRAULICALLY ASSISTED DEPLOYED ESP SYSTEM

CROSS REFERENCE TO RELATED APPLICATIONS

This application claims priority to and the benefit of U.S. Provisional Application No. 62/099,253, titled "Hydraulically Assisted Deployed ESP System," filed Jan. 2, 2015, the full disclosure of which is hereby incorporated by reference herein in its entirety.

BACKGROUND OF THE INVENTION

1. Field of the Invention

The present invention relates generally to improving production from subterranean wells with artificial lift, and in particular systems and methods for deploying electric submersible pumps.

2. Description of the Related Art

In hydrocarbon developments, it is common practice to use electric submersible pumps (ESPs) as a primary form of artificial lift. Artificial lift in oil and gas production uses ESPs in the wellbore to lift fluids from downhole to surface and push them to processing facilities. The ESPs of some current systems can be conveyed with the production tubing or coiled tubing. However, tubing installed systems require workover rigs for installing, removing, and changing out the ESPs. In addition, changing pump setting depth requires workover rigs to pull out the tubing and re-install the landing profile at a different depth. An ESPs' run life is relatively short. When the equipment fails, a workover rig is required to pull out the failed equipment and install a new system. Changing pump depth is not uncommon. Often, as reservoir pressure, water cut or productivity changes, it is necessary to install the pump system at a different depth in order to optimize system performances. Workover rigs are expensive and the waiting time for rigs can be long.

SUMMARY OF THE DISCLOSURE

Embodiments of the present disclosure provide systems and methods for installing ESPs, and performing frequent ESP change outs without the need for high cost rigs. Embodiments of this disclosure can deploy and retrieve ESPs using hydraulic power and eliminating the need of some conventional high cost ESP deployments that require using a rig or coiled tubing deployment systems. The system is self-contained and does not require the use of conventional lubricators, minimizes the surface equipment footprint, and reduces the time needed to deploy and retrieve ESPs compared to some current ESP installation systems.

In an embodiment of this disclosure, a method for providing artificial lift to production fluids within a subterranean well includes loading an electrical submersible pump assembly into an interior cavity of a pump launcher. The electrical submersible pump assembly has a motor and a pump, and is releasably secured to a piston device. The piston device has an outer diameter profile. The pump launcher is releasably secured to a wellhead so that the interior cavity is in fluid communication with an inner bore of a production tubing that extends a length into the subterranean well. A propulsion system is activated to move the electrical submersible pump assembly from the pump launcher and into the subterranean well. By communicating with the piston device, the descent of the electrical submersible pump assembly through the subterranean well is controlled.

In alternate embodiments, the electrical submersible pump assembly can be moved through the subterranean well with the propulsion system until the electrical submersible pump assembly reaches a set packer. The electrical submersible pump assembly can be latched to the set packer. The electrical submersible pump assembly can be unlatched from the set packer and returned to the pump launcher with the propulsion system. The speed of the electrical submersible pump assembly can be monitored with a guide wire, the guide wire being a non-load bearing cable that extends from the electrical submersible pump assembly to the pump launcher. A condition of the subterranean well can be sensed with the piston device.

In other alternate embodiments, the propulsion system includes a valve system and a surface pump in fluid communication with the valve system. The step of activating the propulsion system can include pressurizing a circulating fluid with the surface pump and moving the circulating fluid through the valve system so that the valve system directs the circulating fluid into and out of the well to act on pressure surfaces of the piston device. The step of communicating with the piston device to control the descent of the electrical submersible pump assembly through the subterranean well can include changing the outer diameter profile of the piston device to change a vector sum of forces applied on the pressure surfaces of the piston device. A speed and direction of movement of the electrical submersible pump assembly through the subterranean well can be controlled by changing a pressure and direction of flow of the circulating fluid with the surface pump.

In yet other alternate embodiments, the propulsion system comprises a self-powered robotic system including a propulsion mechanism, the self-powered robotic system being part of the piston device. The step of activating the propulsion system can include remotely controlling the self-powered robotic system. The propulsion mechanism can include a propeller and a driver to rotate the propeller, and the method can further include controlling a speed and direction of movement of the electrical submersible pump assembly through the subterranean well by remotely controlling the driver.

In an alternate embodiment of the current disclosure, a method for providing artificial lift to production fluids within a subterranean well includes loading an electrical submersible pump assembly into an interior cavity of a pump launcher. The electrical submersible pump assembly has a motor and a pump and is releasably connected to a piston device. The piston device has a controllable outer diameter profile. The pump launcher is releasably secured to a wellhead so that the interior cavity is in fluid communication with an inner bore of a production tubing that extends a length into the subterranean well. A valve system is operated to provide a flow path for a circulating fluid from a surface pump to the inner bore of the production tubing. The circulating fluid is pressurized with the surface pump and the circulating fluid is moved through the valve system so that the valve system directs the circulating fluid into the inner bore of the production tubing to act on pressure surfaces of the piston device to move the electrical submersible pump assembly from the pump launcher and into the subterranean well. By communicating with the piston device, the outer diameter profile of the piston device can be changed to control the descent of the electrical submersible pump assembly through the subterranean well.

In alternate embodiments, the valve system can be operated to provide a return flow path for the circulating fluid from a surface pump to the subterranean well in an annular space outside of the production tubing to move the electrical submersible pump assembly from the production tubing to the pump launcher. The speed of the electrical submersible pump assembly can be monitored with a guide wire, the guide wire being a non-load bearing cable that extends from the electrical submersible pump assembly to the pump launcher. The step of communicating with the piston device can include communicating with the piston device through a guide wire that extends from the electrical submersible pump assembly to the pump launcher.

In yet another alternate embody of this disclosure, an electric submersible pump system for providing artificial lift to production fluids within a subterranean well includes a pump launcher releasably secured to a wellhead. The pump launcher has an interior cavity in fluid communication with an inner bore of a production tubing that extends a length into the subterranean well. The electric submersible pump system includes an electrical submersible pump assembly having a motor and a pump. A piston device is releasably secured to the electrical submersible pump assembly. The piston device has a controllable outer diameter profile selectively engaging the inner bore of a production the well. A propulsion system is associated with the piston device, selectively moving the electrical submersible pump assembly through the production tubing.

In alternate embodiments, the propulsion system can include a valve system selectively directing a circulating fluid into and out of the well, and a surface pump in fluid communication with the valve system selectively pressurizing the circulating fluid and moving the circulating fluid through the valve system. The piston device can have a top pressure surface acted on by the circulating fluid to move the electrical submersible pump assembly through the production tubing, and a bottom pressure surface acted on by the circulating fluid to move the electrical submersible pump assembly out of the well.

In other alternate embodiments, a guide wire can be connected to the piston device and extend out of the well to a surface location, the guide wire being non-load bearing and being in signal communication with the surface location.

In yet other alternate embodiments, the propulsion system can include a self-powered robotic system including a propulsion mechanism.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
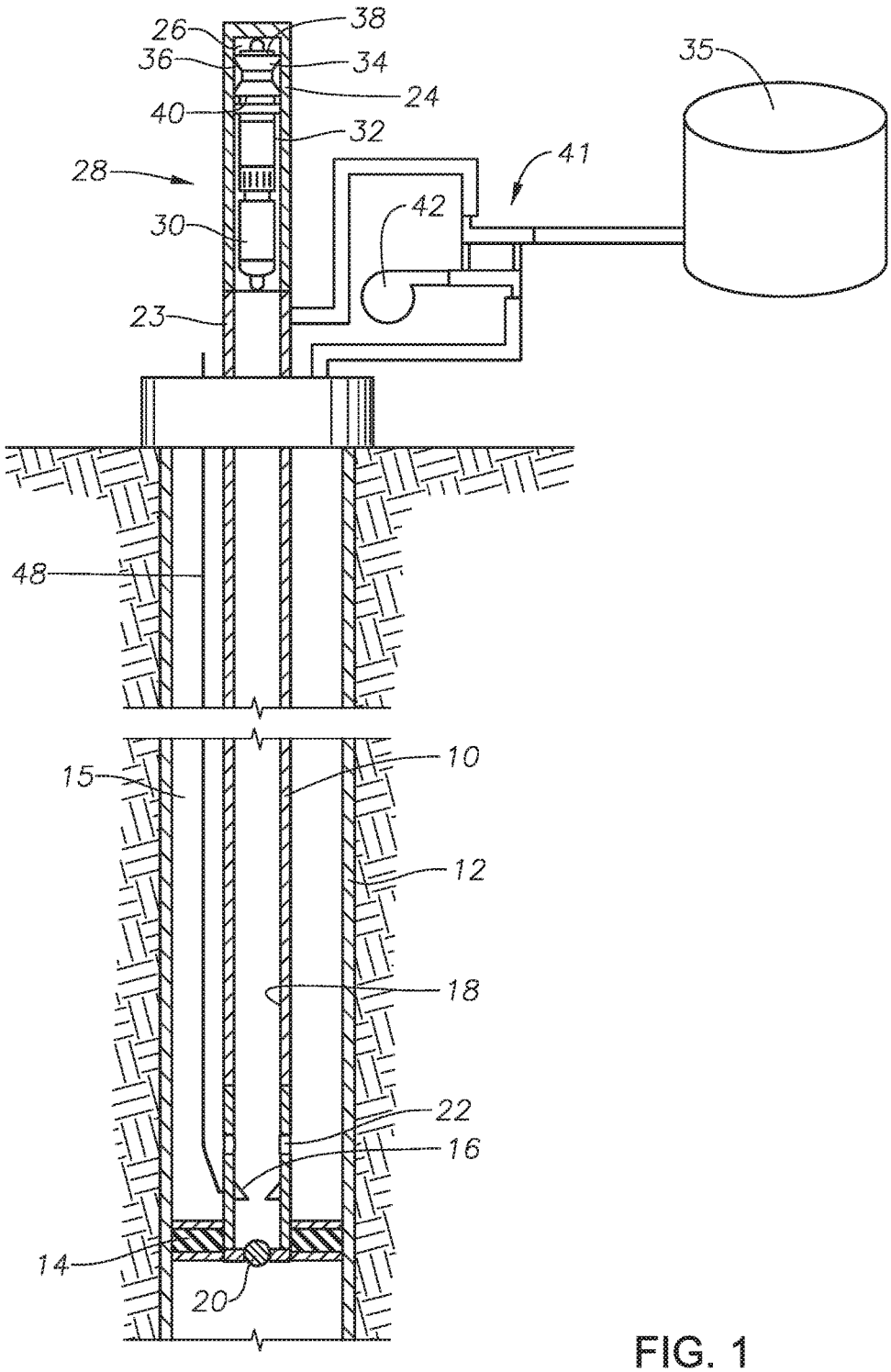
FIG. 1 is a schematic partial section view of an ESP system in accordance with an embodiment of this disclosure, shown in a launching position.

Looking at FIG. 1, production tubing 10 extends a length into subterranean well 12. Subterranean well 12 can be a cased well, with a series of casing, and in alternate embodiments, can have a section that is open or uncased. A sealing device, such as tubing packer 14 can be located in the annular space 15 outside of production tubing 10, between the inner diameter of the subterranean well 12 and the outer diameter of production tubing 10. A landing location, such as set packer 16 can be located at a predetermined distance within an inner bore 18 of production tubing 10.

Figure 2:
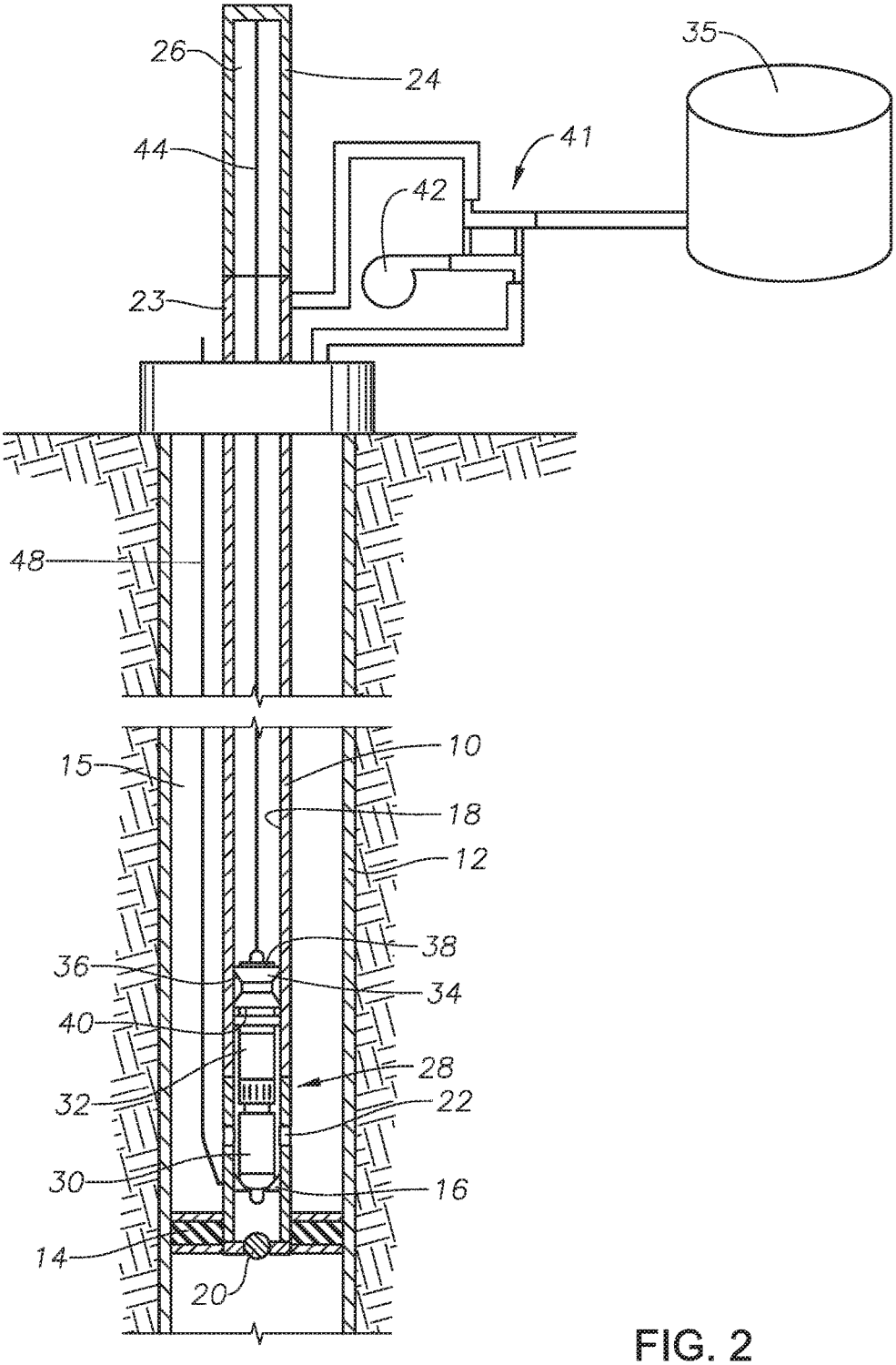
FIG. 2 is a schematic partial section view of the ESP system of FIG. 1, shown in an installed position.
Figure 3:
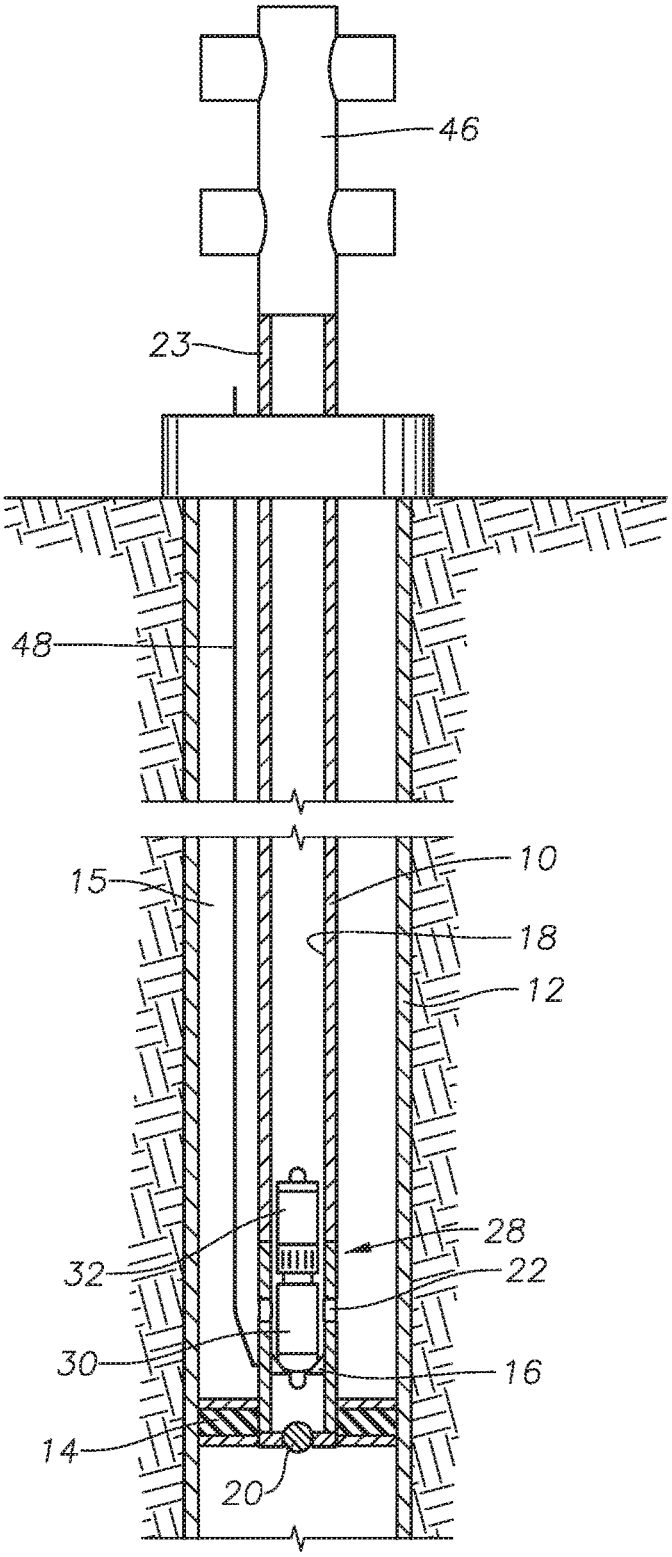
FIG. 3 is a schematic partial section view of the ESP system of FIG. 1, shown in an operating position.

Production tubing 10 can include a sealable production fluid inlet 20 and circulation fluid inlets 22. Production fluid inlet 20 provides a fluid path between a region of the well below tubing packer 14, and inner bore 18 of production tubing 10. Circulation fluid inlets 22 provide a fluid path between annular space 15 above tubing packer 14, and inner bore 18 of production tubing 10. In the examples of FIGS. 1-3, tubing packer 14 and production fluid inlet 20 are shown at a lower end of production tubing 10. In alternate embodiments, tubing packer 14 and production fluid inlet 20 can be located at an intermediate distance along production tubing 10 in order to access production fluid that are located at other depths along production tubing 10.

Still looking at FIG. 1, wellhead 23 is located at or above the earth's surface at an upper end of subterranean well 12. Pump launcher 24 can be releasably secured to wellhead 23 so that that interior cavity 26 of pump launcher 24 is in fluid communication with inner bore 18 of production tubing 10. Electrical submersible pump assembly 28 can be located within interior cavity 26. Electrical submersible pump assembly 28 can include motor 30, pump 32. Piston device 34 can be releasably attached to electrical submersible pump assembly 28.

Considering FIGS. 1-3, a propulsion system used in connection with piston device 34 will move electrical submersible pump assembly 28 through inner bore 18. The propulsion system can move electrical submersible pump assembly 28 through subterranean well 12 until electrical submersible pump assembly 28 reaches set packer 16. Electrical submersible pump assembly 28 can then be latched to set packer 16. To reverse the operation and remove electrical submersible pump assembly 28 from subterranean well 12, electrical submersible pump assembly 28 can be unlatched from set packer 16 and returned to pump launcher 24 with the propulsion system.

Looking at an example embodiment of FIGS. 1-2, piston device 34 has an outer diameter profile 36. Outer diameter profile 36 can be changed to change a vector sum of forces applied on pressure surfaces 38, 40 and outer diameter surfaces of piston device 34, to control the rate of speed of the descent or rise of electrical submersible pump assembly 28 through inner bore 18 of production tubing 10. Top pressure surface 38 is an upward facing surface that is acted on by circulation fluids that are pumped downward into inner bore 18 of production tubing 10. Bottom pressure surface 40 is a downward facing surface that is acted on by circulation fluids that are pumped upward through inner bore 18 of production tubing 10. In the example embodiment of FIGS. 1-2, the propulsion system includes valve system 41 and surface pump 42 in fluid communication with valve system 41 so that activating the propulsion system includes pressurizing a circulating fluid with surface pump 42 and moving the circulating fluid through valve system 41 so that valve system 41 directs the circulating fluid into and out of subterranean well 12 to act on pressure surfaces 38, 40 of piston device 34.

A circulation fluid source 35 can contain circulating fluid for use with surface pump 42 and valve system 41 of the propulsion system. Valve system 41 can include piping that connects circulation fluid source 35 with inner bore 18, annular space 15, and surface pump 42. A 4-way valve can control the direction of the flow of circulation fluids through valve system 41.

As an example, if outer diameter profile 36 has a smaller outer diameter than the inner diameter of inner bore 18, then the larger the pressure surfaces 38, 40, the more surface area will be subjected to the force of the circulating fluid and the faster electrical submersible pump assembly 28 can be moved through inner bore 18. However, if pressure surfaces 38, 40 are sized so that the outer diameter of piston device 34 engage the inner diameter surface of inner bore 18, the engagement of outer diameter of piston device 34 with inner bore 18, and forces resulting therefrom, will slow the rate of speed of electrical submersible pump assembly 28 through inner bore 18. The greater the interaction between the outer diameter of piston device 34 and the inner diameter surface of inner bore 18, the greater the resistance of such interaction to the circulation fluids pushing on pressure surfaces 38, 40.

Outer diameter profile 36 can be changed to be sized so that the forces generated by the interaction between the outer diameter of piston device 34 and the inner diameter surface of inner bore 18 will act as a brake and prevent electrical submersible pump assembly 28 from moving through inner bore 18. Alternately, the pressure of the circulating fluid and the direction of flow of the circulating fluid can be changed with surface pump 42 and valve system 41 to control the speed and direction of movement of electrical submersible pump assembly 28 through the subterranean well 12.

The speed of electrical submersible pump assembly 28 can be monitored with guide wire 44 (FIG. 2). Guide wire 44 is a non-load bearing cable that extends from electrical submersible pump assembly 28 to pump launcher 24. Guide wire 44 provides a means of signal communication between a surface location and piston device 34, to control piston device 34. Piston device 34 can sense a condition of subterranean well 12, such as a temperature, pressure, and depth measurements. Guide wire 44 can convey such information to a surface location.

Figure 4:
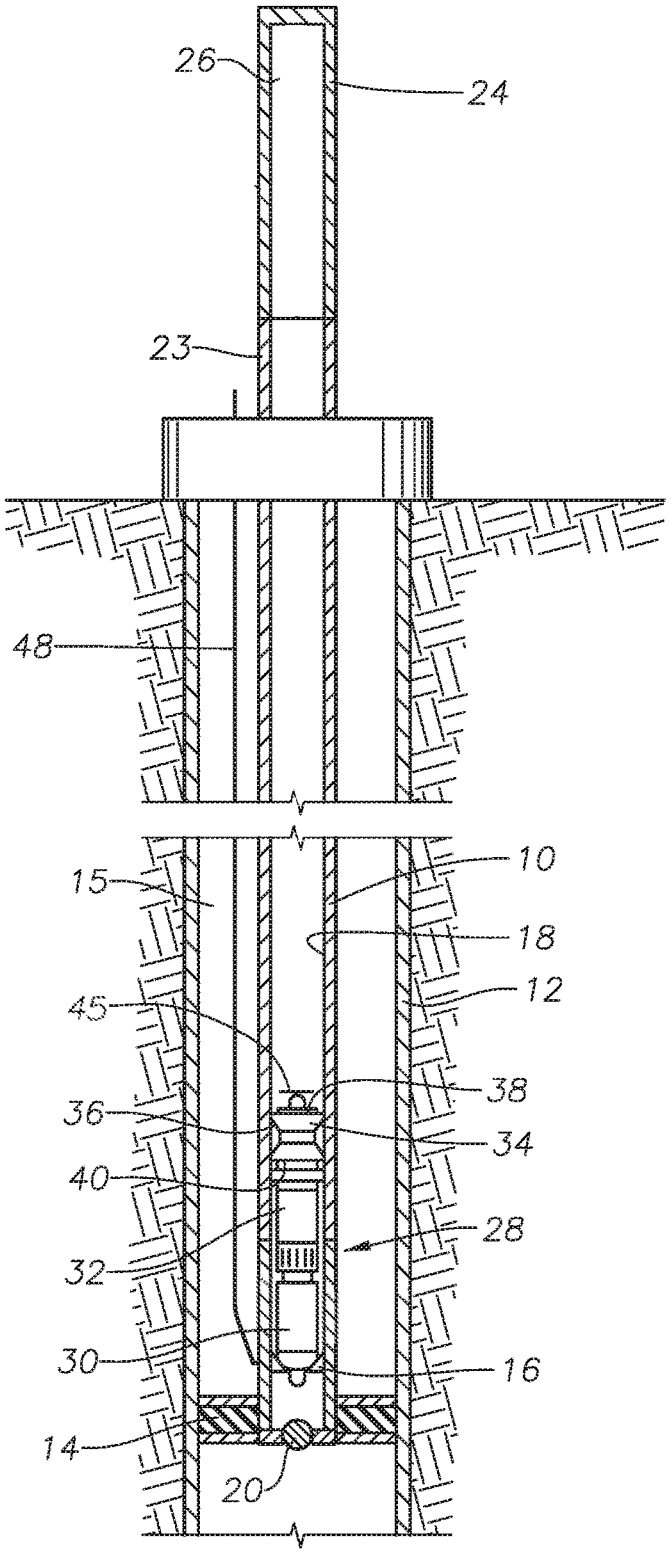
FIG. 4 is a schematic partial section view of an ESP system in accordance with an embodiment of this disclosure, shown in an installed position.

In alternate embodiments, such as shown in Fig. 4, piston device 34 itself can be the propulsion mechanism and can be a self-powered robotic system. In such an embodiment, activating the propulsion system includes controlling the self-powered robotic system of piston device 34. The self-powered robotic system of piston device 34 can be controlled remotely or can be controlled through guide wire 44. The self-powered robotic system of piston device 34 can include a propulsion mechanism, such as a motor or turbine. The propulsion mechanism can rotate propeller 45 and the speed and direction of movement of electrical submersible pump assembly 28 through subterranean well 12 can be controlled by controlling the driver. In such an embodiment, surface pump 42 and valve system 41 may not be needed and can be excluded.

Looking at FIG. 1, in an example of operation, electrical submersible pump assembly 28 can be loaded into interior cavity 26 of pump launcher 24. Pump launcher 24 is releasably secured to wellhead 23 so that interior cavity 26 is in fluid communication with inner bore 18 of production tubing 10. A propulsion system can be activated to move electrical submersible pump assembly 28 from pump launcher 24 and into subterranean well 12. Gravity can assist with moving electrical submersible pump assembly 28 through subterranean well 12 and a propulsion system will move electrical submersible pump assembly 28 through inner bore 18. Communication with piston device 34 can cause piston device 34 to control the descent of electrical submersible pump assembly 28 through subterranean well 12.

Looking at FIG. 2-3, the electrical submersible pump assembly 28 can move downward through inner bore 18 until electrical submersible pump assembly 28 lands on set packer 16. Electrical submersible pump assembly 28 can then be latched to set packer 16 to retain electrical submersible pump assembly 28 in position. Looking at FIG. 3, piston device 34 can be released from electrical submersible pump assembly 28 and returned to a surface location. Alternately, the outer diameter of piston device 34 can be reduced so that production fluids can pass by piston device 34 within inner bore 18. Circulation fluid inlets 22 can be closed to prevent fluid from above tubing packer 14 from entering production tubing 10. Production fluid inlet 20 can be opened so that a lower end of electrical submersible pump assembly 28 will be in fluid communication with production fluids that are located below tubing packer 14. Pump launcher 24 can be removed and replaced with a wellhead assembly such as tree 46 and production fluids can flow up through inner bore 18 of production tubing 10.

Electrical submersible pump assembly 28 can be activated to provide additional lift to the production fluid as it travels through production tubing 10. Production fluids will enter a lower end of electrical submersible pump assembly 28 and exit electrical submersible pump assembly 28 at a higher location before continuing up production tubing 10. A communication line or cable 48 can be used to send signals to set packer 16, circulation fluid inlets 22, and production fluid inlet 20, to perform their respective functions. Cable 48 can also be used to provide a signal and power to electrical submersible pump assembly 28.

In order to reverse the process and remove electrical submersible pump assembly 28 from production tubing 10, production fluid inlet 20 can be closed, tree 46 can be removed and pump launcher 24 can be reattached to wellhead 23. Piston device 34 can be reattached to electrical submersible pump assembly 28 and the propulsion system can move electrical submersible pump assembly 28 upwards through inner bore 18 to return to pump launcher 24.

In one example embodiment of FIGS. 1-2, the propulsion system can include valve system 41 can include a four way valve that can be actuated so that circulation fluids from fluid source 35 can be directed down inner bore 18 to push electrical submersible pump assembly 28. Circulation fluids can then exit inner bore 18 through circulation fluid inlets 22. Tubing packer 14 will prevent circulation fluids from traveling downward through annular space 15 so circulation fluids will travel up through annular space 15 and enter valve system 41. As described above, the operator can communicate with piston device 34 to change an outer diameter profile 36, to control the rate of speed of the descent or rise of electrical submersible pump assembly 28 through inner bore 18 of production tubing 10. In addition, surface pump 42 can change the speed and direction of the circulation fluids to also control the movement of electrical submersible pump assembly 28.

When removing the electrical submersible pump assembly 28 from production tubing 10, the four way valve that can be actuated so that circulation fluids from fluid source 35 can be directed down through annular space 15, through circulation fluid inlets 22 and up inner bore 18 to push electrical submersible pump assembly 28 out of inner bore 18.

In an alternate example embodiment, the propulsion system can be piston device 34 and piston device 34 can be a self-powered robotic system. As described above, in such an embodiment, the self-powered robotic system of piston device 34 can be controlled remotely or can be controlled through guide wire 44. The self-powered robotic system of piston device 34 can include a propulsion mechanism, such as a motor or turbine. The propulsion mechanism can rotate a propeller and the speed and direction of movement of electrical submersible pump assembly 28 through subterranean well 12 can be controlled by controlling the driver.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method for providing artificial lift to production fluids within a subterranean well, the method comprising:

loading an electrical submersible pump assembly into an interior cavity of a pump launcher, the electrical submersible pump assembly having a motor, and a pump and being releasably secured to a piston device, the piston device having an outer diameter profile;

releasably securing the pump launcher to a wellhead so that the interior cavity is in fluid communication with an inner bore of a production tubing that extends a length into the subterranean well;

activating a propulsion system to move the electrical submersible pump assembly from the pump launcher and into the subterranean well, wherein the propulsion system includes a reversible surface valve system and a surface pump in fluid communication with the reversible surface valve system; and communicating with the piston device to control a descent of the electrical submersible pump assembly through the subterranean well.

2. The method according to claim 1, further comprising moving the electrical submersible pump assembly through the subterranean well with the propulsion system until the electrical submersible pump assembly reaches a set packer, then latching the electrical submersible pump assembly to the set packer.

3. The method according to claim 2, further comprising unlatching the electrical submersible pump assembly from the set packer and returning the electrical submersible pump assembly to the pump launcher with the propulsion system.

4. The method according to claim 1, wherein the step of activating the propulsion system includes pressurizing a circulating fluid with the surface pump and moving the circulating fluid through the valve system so that the valve system directs the circulating fluid into the production tubing and out of an annular space between an inner diameter of the subterranean well and an outer diameter of production tubing to act on pressure surfaces of the piston device.

5. The method according to claim 4, wherein the step of communicating with the piston device to control the descent of the electrical submersible pump assembly through the subterranean well includes changing the outer diameter profile of the piston device to change a vector sum of forces applied on the pressure surfaces of the piston device.

6. The method according to claim 4, further comprising controlling a speed and direction of movement of the electrical submersible pump assembly through the subterranean well by changing a pressure and direction of flow of the circulating fluid with the surface pump.

7. The method according to claim 1, further comprising monitoring a speed of the electrical submersible pump assembly with a guide wire, the guide wire being a non-load bearing cable that extends from the electrical submersible pump assembly to the pump launcher.

8. The method according to claim 1, further comprising sensing a condition of the subterranean well with the piston device.

9. The method according to claim 1, wherein activating the propulsion system includes pressurizing a circulating fluid with the surface pump and moving the circulating fluid through the valve system so that the valve system directs the circulating fluid through a circulation fluid inlet that extends through the production tubing axially below the piston device, the circulation fluid inlet providing fluid communication between the inner bore of the production tubing and an annular space defined between an inner diameter of the subterranean well and an outer diameter of production tubing.

10. A method for providing artificial lift to production fluids within a subterranean well, the method comprising:

loading an electrical submersible pump assembly into an interior cavity of a pump launcher, the electrical submersible pump assembly having a motor, a pump and being releasably secured to a piston device, the piston device having an outer diameter profile;

releasably securing the pump launcher to a wellhead so that the interior cavity is in fluid communication with an inner bore of a production tubing that extends a length into the subterranean well;

operating a surface valve system to provide a flow path for a circulating fluid from a surface pump to the inner bore of the production tubing and out of an annular space between an inner diameter of the subterranean well and an outer diameter of production tubing;

pressurizing the circulating fluid with the surface pump and moving the circulating fluid through the valve system so that the valve system directs the circulating fluid into the inner bore of the production tubing to act on pressure surfaces of the piston device to move the electrical submersible pump assembly from the pump launcher and into the subterranean well; and communicating with the piston device to change the outer diameter profile of the piston device to control a descent of the electrical submersible pump assembly through the subterranean well.

11. A method according to claim 10, further comprising operating the valve system to reverse the circulating fluid so that the circulating fluid flows in a return flow path from the surface pump to the subterranean well in the annular space and up the inner bore of the production tubing to move the electrical submersible pump assembly from the production tubing to the pump launcher.

12. A method according to claim 10, further comprising monitoring a speed of the electrical submersible pump assembly with a guide wire, the guide wire being a non-load bearing cable that extends from the electrical submersible pump assembly to the pump launcher.

13. A method according to claim 10, wherein communicating with the piston device includes communicating with the piston device through a guide wire that extends from the electrical submersible pump assembly to the pump launcher.

14. An electric submersible pump system for providing artificial lift to production fluids within a subterranean well, the system comprising:

a pump launcher releasably secured to a wellhead, the pump launcher having an interior cavity in fluid communication with an inner bore of a production tubing that extends a length into the subterranean well;

an electrical submersible pump assembly having a motor and a pump;

a piston device releasably secured to the electrical submersible pump assembly, the piston device having a controllable outer diameter profile selectively engaging the inner bore of the subterranean well; and a propulsion system associated with the piston device selectively moving the electrical submersible pump assembly through the production tubing, wherein the propulsion system includes a surface valve system and a surface pump in fluid communication with the surface valve system, the propulsion system operable to pressurize a circulating fluid with the surface pump and move the circulating fluid through the valve system so that the valve system directs the circulating fluid into the production tubing and out of an annular space between an inner diameter of the subterranean well and an outer diameter of production tubing to act on pressure surfaces of the piston device.

15. The system according to claim 14, wherein the piston device has a top pressure surface acted on by the circulating fluid to move the electrical submersible pump assembly through the production tubing.

16. The system according to claim 14, wherein the piston device has a bottom pressure surface acted on by the circulating fluid to move the electrical submersible pump assembly out of the subterranean well.

17. The system according to claim 14, further comprising a guide wire connected to the piston device and extending out of the subterranean well to a surface location, the guide wire being non-load bearing and being in signal communication with the surface location.

* * * * *